US010898990B2

(12) United States Patent
Wilson et al.

(10) Patent No.: US 10,898,990 B2
(45) Date of Patent: Jan. 26, 2021

(54) CO-CENTRIC PIN SPANNER TOOL

(71) Applicant: Motion Pro, Inc., Loomls, CA (US)

(72) Inventors: Jeffrey Nicholas Wilson, Roseville, CA (US); Steven Richard Scott, Curlew, WA (US)

(73) Assignee: Motion Pro, Inc., Loomis, CA (US)

( * ) Notice: Subject to any disclaimer, the term of this patent is extended or adjusted under 35 U.S.C. 154(b) by 164 days.

(21) Appl. No.: 15/789,973

(22) Filed: Oct. 21, 2017

(65) Prior Publication Data

US 2019/0118351 A1 Apr. 25, 2019

(51) Int. Cl.

| | |
|---|---|
| ***B25B 13/48*** | (2006.01) |
| ***B25B 13/30*** | (2006.01) |
| ***B25B 13/28*** | (2006.01) |
| ***B25B 23/00*** | (2006.01) |

(52) U.S. Cl.

CPC ..... *B25B 13/481* (2013.01); *B25B 13/28* (2013.01); *B25B 13/30* (2013.01); *B25B 13/48* (2013.01); *B25B 23/0007* (2013.01)

(58) Field of Classification Search

CPC ..... B25B 13/10; B25B 13/28; B25B 13/30; B25B 13/48; B25B 13/481; B25B 23/0007; B25B 7/06; B25B 27/20

USPC ..... 81/176.3, 300, 416

See application file for complete search history.

(56) References Cited

U.S. PATENT DOCUMENTS

| | | | | | |
|---|---|---|---|---|---|
| 2,605,665 | A * | 8/1952 | Grenat | B25F 1/00 | 81/124.4 |
| 2,614,445 | A * | 10/1952 | Riordan | B25B 13/48 | 81/176.3 |
| 2,810,313 | A * | 10/1957 | Hermanson | B25B 13/46 | 81/176.3 |
| 2,939,215 | A * | 6/1960 | Putsch | B25B 7/08 | 30/266 |
| 4,063,475 | A * | 12/1977 | Perkins | B25B 17/00 | 81/57.22 |
| 4,210,037 | A * | 7/1980 | Taylor | B25B 13/10 | 81/176.2 |
| 4,237,755 | A * | 12/1980 | Gunnell, III | B25B 13/48 | 81/176.15 |
| 5,365,809 | A * | 11/1994 | Hsiao | B25B 13/10 | 81/176.1 |
| 6,176,158 | B1 * | 1/2001 | Chen | B25B 7/06 | 81/394 |
| 7,114,417 | B1 * | 10/2006 | Dring | B25B 13/10 | 81/176.3 |
| 7,272,996 | B2 * | 9/2007 | Pontieri | B24B 45/003 | 81/176.15 |
| 2006/0070498 | A1 * | 4/2006 | Buchanan | B25B 13/04 | 81/90.1 |
| 2011/0214538 | A1 * | 9/2011 | Huang | B25B 27/20 | 81/302 |
| 2012/0137840 | A1 * | 6/2012 | Chen | B25B 7/18 | 81/427 |

(Continued)

*Primary Examiner* — Monica S Carter
*Assistant Examiner* — Marcel T Dion
(74) *Attorney, Agent, or Firm* — Patent Law Office of Larry Guernsey; Larry B. Guernsey

(57) ABSTRACT

A pin spanner tool for use with a driver having a center of rotation, the pin spanner having a driven arm, a floating arm, and a bolt connecting the driven arm and the floating arm, where the bolt has a center of rotation which is co-centric with the center of rotation of the driver.

6 Claims, 8 Drawing Sheets

(56) References Cited

U.S. PATENT DOCUMENTS

| | | | | |
|---|---|---|---|---|
| 2014/0053694 | A1* | 2/2014 | Lin Wu | B25B 7/10<br>81/416 |
| 2014/0174265 | A1* | 6/2014 | Wirth | B25B 13/50<br>81/450 |
| 2017/0136610 | A1* | 5/2017 | Griffin | B25B 13/48 |

* cited by examiner

CO-CENTRIC PIN SPANNER TOOL

TECHNICAL FIELD

The present invention relates generally to tools for applying measured torque to mechanical components.

BACKGROUND ART

There are a number of applications in which a specialized tool called a pin spanner is necessary to install or remove various engine or mechanical components. These components are configured with indents or holes which are engaged by pins on the pin spanner tool, and torque applied to the tool which is then transmitted to the component to rotate it, typically to screw or unscrew the component from a fixture. Often, the amount of torque applied is important to make sure that the component is not over-tightened or under-tightened, so a torque-wrench may be used.

The problem may be compounded when the component is located in an inaccessible area where direct access to the pin indents is not possible. In this case, the tightening tool may need to reach laterally under overhanging items in order to engage the pins into the pin indents. This extended reach presents the difficulty that the tool may need to remain level while applying torque to the component, so that the pins stay engaged with the pin indents and are not tilted out of the indents.

There have been several prior attempts to fashion a pin spanner. A key variable in these attempts is the placement of the drive mechanism in relation to the spanner arms and pins. A first type is shown in FIGS. 1-2, and will be referred to as the arm drive 1. This arm drive 1 is shown being used to apply torque to the shock absorber 2, which includes a reservoir 3 and a main body 4. The reservoir 3 has indents 5, which are not visible in this figure, which are engaged by pins 6, also not visible here, on the arms 7 of the arm drive. The arms are linked together at a pivot 8, which includes a retaining bolt 9 which engages a nut 10. A torque wrench 11 may have a square drive 12 (not visible here) which engages a square slot 13 (not visible here) located in one of the arms 7.

Referring now particularly to FIG. 2, there is a pivot center of rotation 14 of the torque wrench 11 and a center of rotation 15 of the shock reservoir 3. Line 17 is shown connecting these two centers of rotation 14, 15. Another line 18 is shown connecting the two pins 6. Line 21 marks the centerline of the handle of the wrench 11 and extends to meet the wrench pivot center 14. Where these two lines 17, 21 cross, angle Θ 19 can be seen not to be at 90 degrees. This angle Θ 19 is important because if it is at 90 degrees, then the torque applied by the torque wrench 11 to the pivot center of rotation 14 of the wrench 11 equals the torque transmitted to the center of rotation 15 of the shock reservoir 3. If this angle 19 is not 90 degrees, the torque will be magnified according to the formula $$R = \frac{T \times L}{L + (A \times \cos\theta)},$$

where:

R=corrected torque value (the setting which you would adjust your torque wrench to achieve desired torque value)

T=desired torque value

L=Length of torque wrench (center of drive to center of handle)

A=Extension length (center of drive to center of pins)

Θ=Angle of torque application

As the cos 90=0, torque 1=torque 2. Non-90° angles will provide additional leverage that magnify the applied torque.

In the case of the arm drive spanner 1, angle Θ 19 is not 90 degrees, and thus the torques are not equal. This means that if a specific torque is required to be applied by the torque wrench 11, the magnifier must be calculated and the applied torque by the wrench 11 must be accordingly reduced, which is inconvenient, and may be forgotten when applying the torque, which could possibly damage the shock 2 or other parts. For reference, line 22 is drawn which lies at a 90 degree angle from the line 17 which joins the center of rotation 14, of the wrench 11 to the center of rotation 15 of the reservoir 3. This line 22 shows the required orientation of the wrench, if 1:1 torque is to be maintained.

In addition, when pressure is applied to engage the wrench 11 with the square slot 13, there is a tendency for the wrench 11 to act as a lever, which lifts one or more pins 6 from their engagement with the indents 5, possibly making the tool slip. FIG. 2 shows the arm drive spanner 1 locating the square drive 12 directly in the arm 7 of the spanner 1. Though this is a compact design with a short lever arm to reduce pin lift, the lever arm is in a diagonal direction that can cause the tool to tilt. This is a less stable design. This image shows that a torque wrench 11 cannot easily be engaged into this style of spanner 1 at a 90 degree angle. If not engaged at a 90 degree angle, the use of a torque wrench 11 will magnify the torque input to the fastener/component, so a calculation of applied torque will be necessary.

A second type of pin spanner is shown in FIGS. 3-4, which will be referred to as a rear drive spanner 20. This rear drive spanner 20 is shown being used to apply torque to the a shock absorber 2, which again includes a reservoir 3 and a main body 4. The reservoir 3 has indents 5, which are not visible in this figure, which are engaged by pins 6, also not visible here, on the arms 27 of the arm drive. The arms are linked together at a pivot 28, which includes a retaining bolt 29 which engages a nut 30. A torque wrench 11 again is assumed to have a square drive 12 which engages a square slot 13 located in one of the arms 27.

Referring now particularly to FIG. 4, there is a pivot center of rotation 14 of the wrench 11 and a center of rotation 15 of the shock reservoir 3. Line 17 is shown connecting these two centers of rotation 14, 15. Another line 18 is shown connecting the two pins 6. Line 21 marks the centerline of the handle of the wrench 11 and extends to meet the wrench pivot center 14. Where these two lines 17, 21 cross, angle Θ 19 can be seen not to be at 90 degrees. This angle Θ 19 is important because, as discussed above, if it is at 90 degrees, then the torque applied by the torque wrench 11 to the pivot center of rotation 14 equals the torque transmitted to the center of rotation 15 of the shock reservoir 3. If this angle Θ 19 is not 90 degrees, the torque will be magnified according to the formula above.

In this case, angle Θ 19 is not 90 degrees, and thus the torques are not equal and are unstable. This means that if a required torque is required to be applied by the torque wrench 11, the magnifying factor will vary and applying specific torque will be difficult. FIG. 4 shows that a torque wrench 11 cannot easily be engaged into this style of spanner at a 90 degree angle. The tool will align perpendicularly only in one adjustment position. This is the only position that allows the user to easily orient the torque wrench in a 1:1 torque configuration. Again, for reference, line 22 is shown which lies at a 90 degree angle from the line 17 which joins the center of rotation 14, of the wrench 11 to the center of rotation 15 of the reservoir 3. This line 22 shows the required orientation of the wrench, if 1:1 torque is to be maintained.

In addition, when pressure is applied to engage the square drive 12 of the wrench 11 with the square slot 13, there is a tendency for the wrench 11 to act as a lever, which lifts one or more pins 6 from their engagement with the indents 5, possibly making the tool slip.

Thus, there is a need for a pin spanner which provides a stable application of torque, which requires no re-calculation of applied torque and which has increased stability of engagement of the spanner pins and the indents.

DISCLOSURE OF INVENTION

Briefly, one preferred embodiment of the present invention is a pin spanner tool where the drive engagement is co-centric with the pivot of the spanner arms.

An advantage of the present invention is that it makes it easier to provide. transmitted torque which is equal to the torque applied to the tool pivot.

Another advantage is that torque is applied to the tool pivot.

A further advantage of the present invention is that the tool can easily apply torque which is not magnified, so no re-calculation of torque is necessary.

Another advantage of the present invention is that it provides a more stable engagement of the spanner pins with the indents of the shock.

These and other advantages of the present invention will become clear to those skilled in the art in view of the description of the best presently known mode of carrying out the invention of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

DETAILED DESCRIPTION OF THE PREFERRED EMBODIMENTS

The present invention is a pin spanner with drive and pivot which are co-centric, meaning that the center of axis of rotation of the drive aligns with the center of axis of rotation of the pivot of the arms. This will be referred to as a co-centric pin spanner and designated as co-centric pin spanner 41. When elements are unchanged from the previous tools discussed above, the numbering will remain the same. When an element is similar to a previous element, but with unique variations of the present invention, an effort will be made to use the same part number, but prefaced by the number "4", so that the previous arms 7, will be numbered arms 47, and so on.

Figure 1:
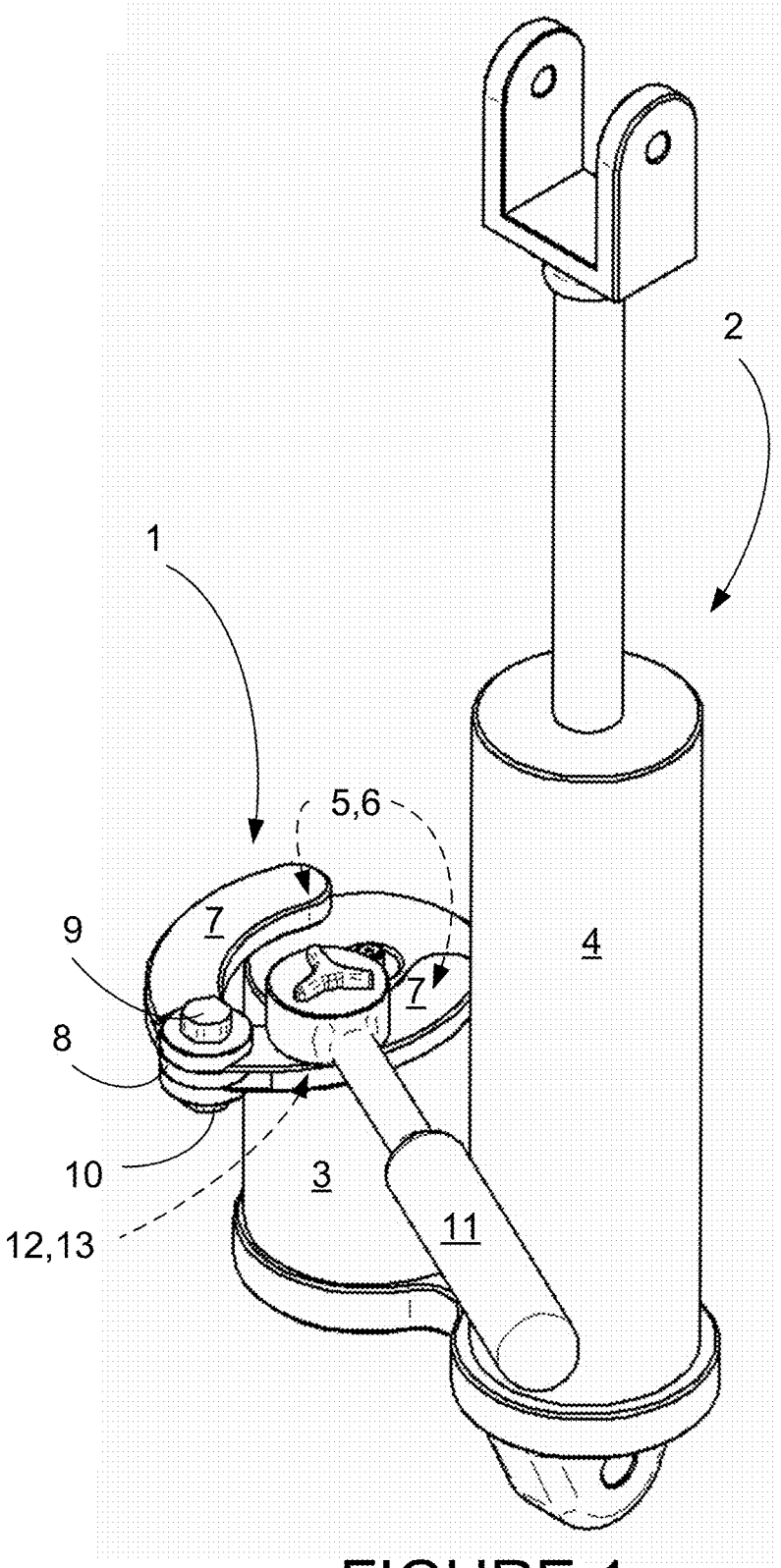
FIGURE 1 PRIOR ART
FIG. 1 shows an isometric view of an arm drive spanner of the prior art with a shock absorber.
Figure 2:
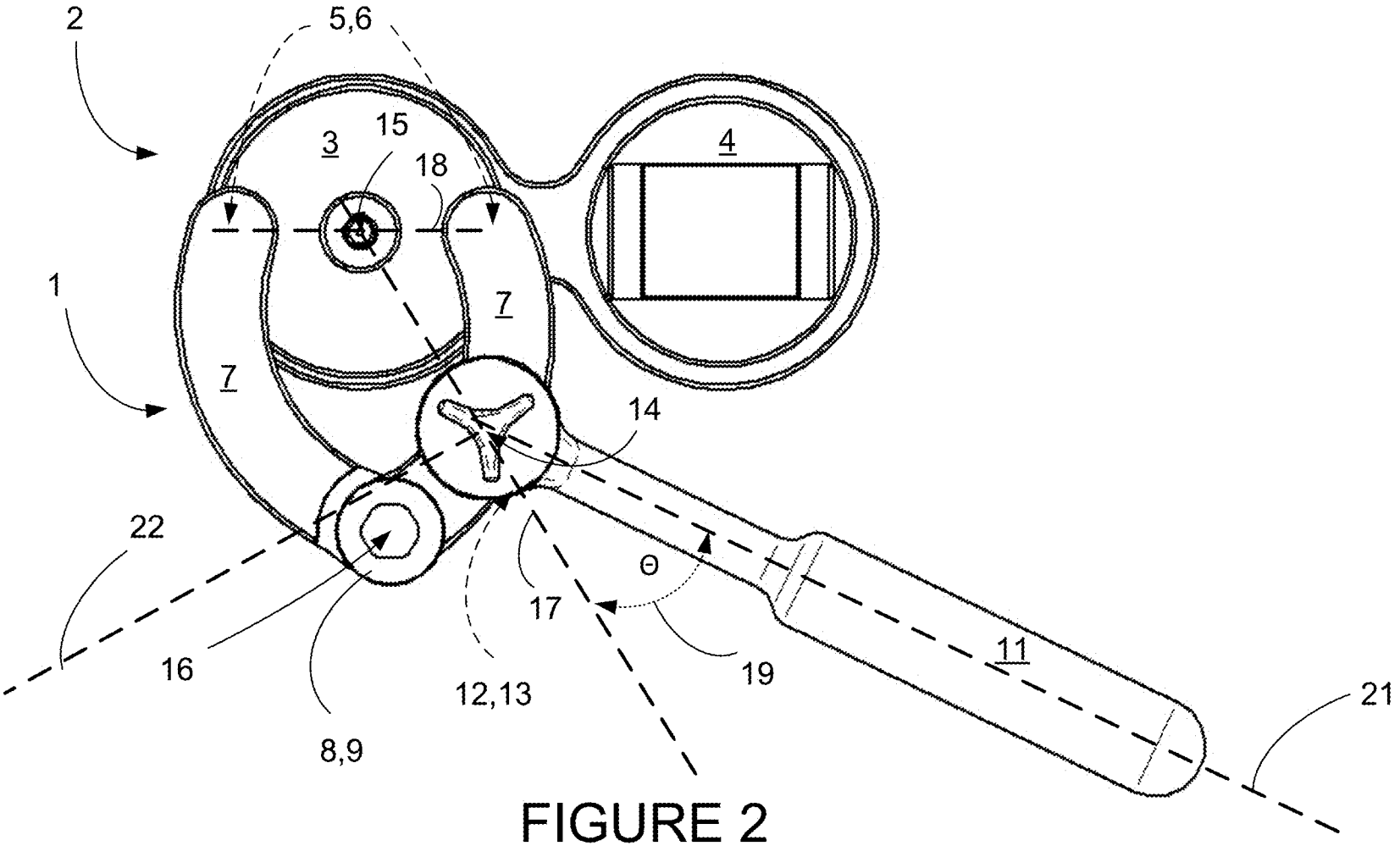
FIGURE 2 PRIOR ART
FIG. 2 shows a top plan view of an arm drive spanner of the prior art with a shock absorber.
Figure 3:
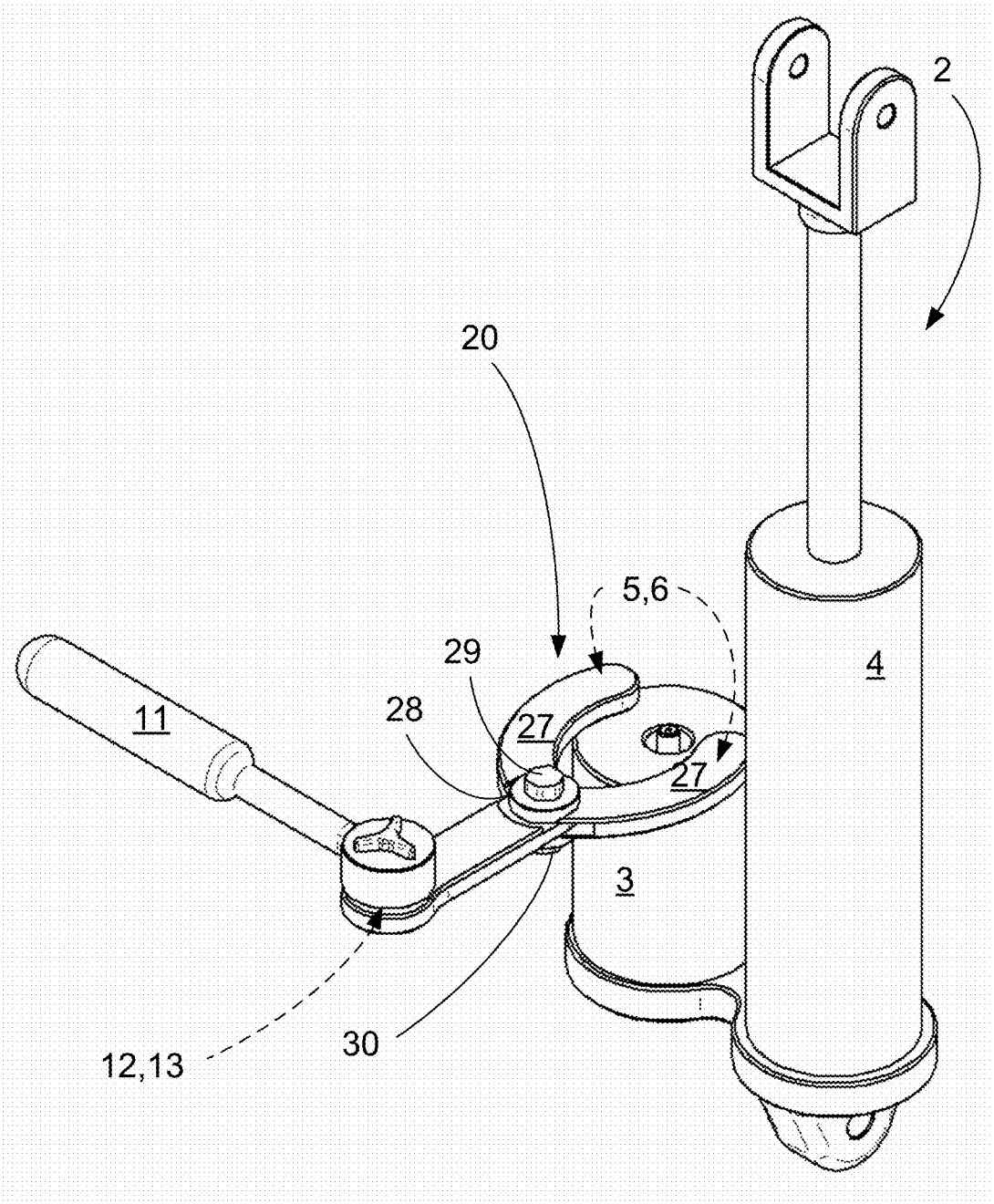
FIGURE 3 PRIOR ART
FIG. 3 shows an isometric view of a rear drive spanner of the prior art with a shock absorber.
Figure 4:
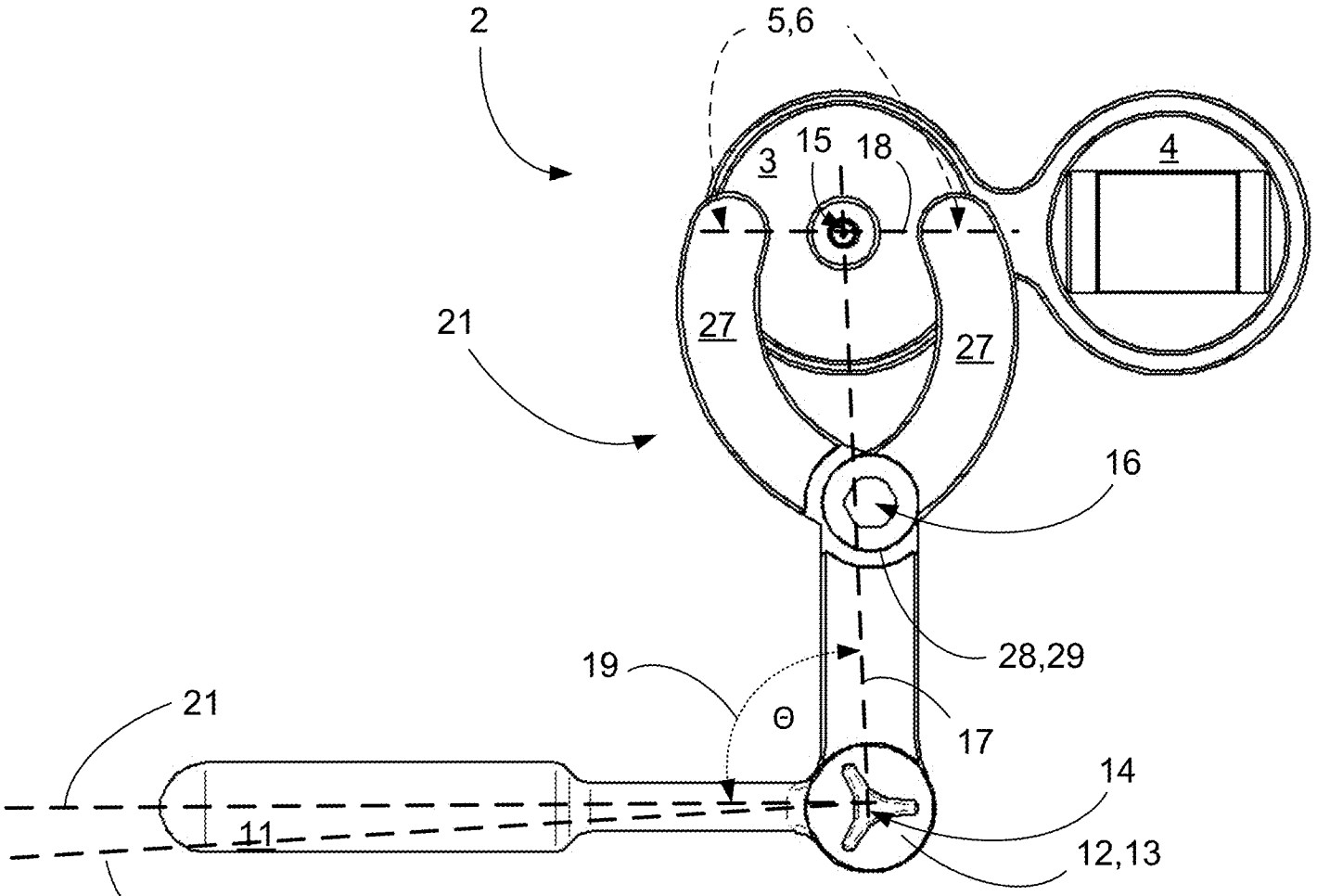
FIGURE 4 PRIOR ART
FIG. 4 shows a top plan view of a rear drive spanner of the prior art with a shock absorber.
Figure 5:
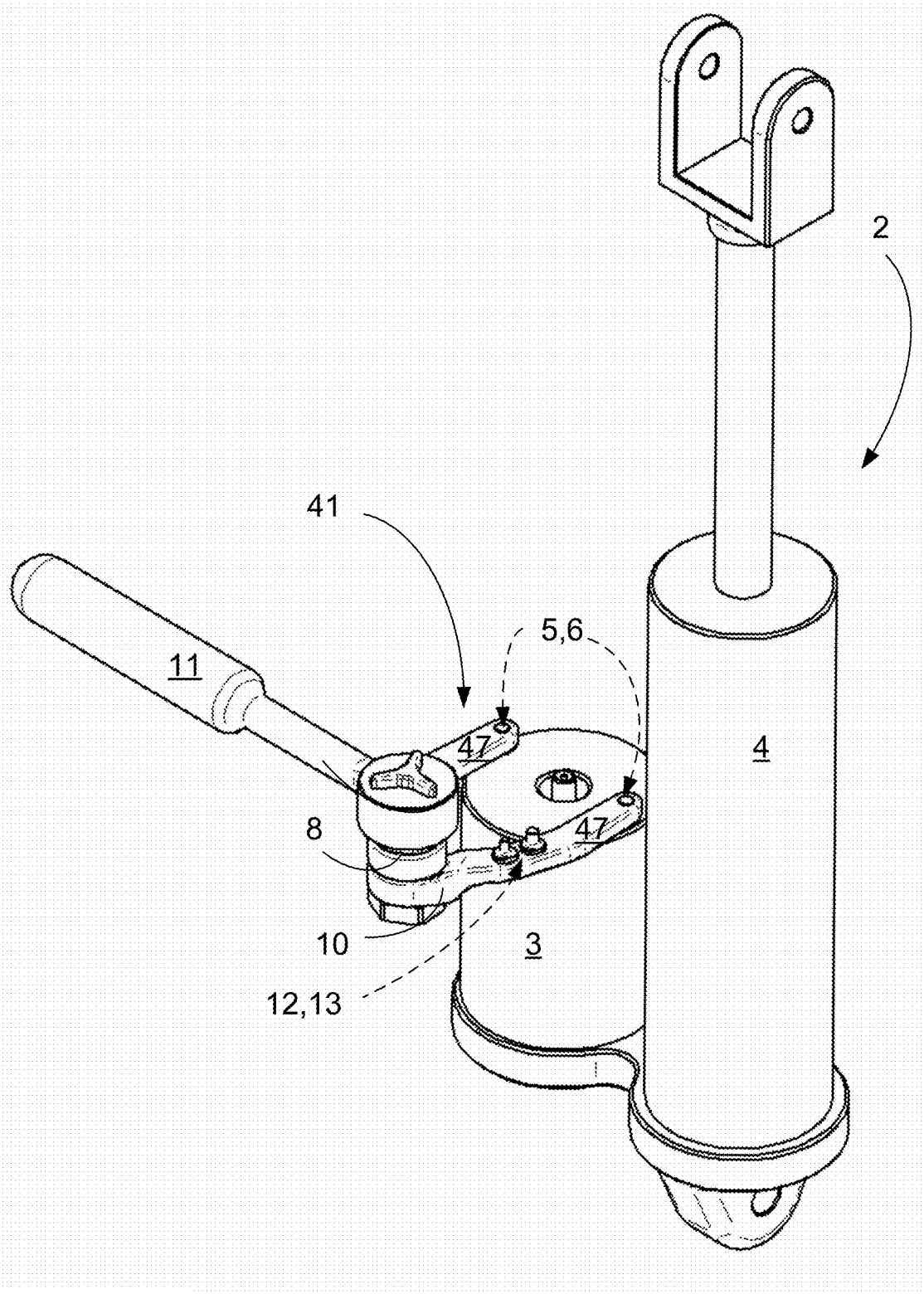
FIG. 5 shows an isometric view of the co-centric pin spanner of the present invention with a shock absorber.
Figure 6:
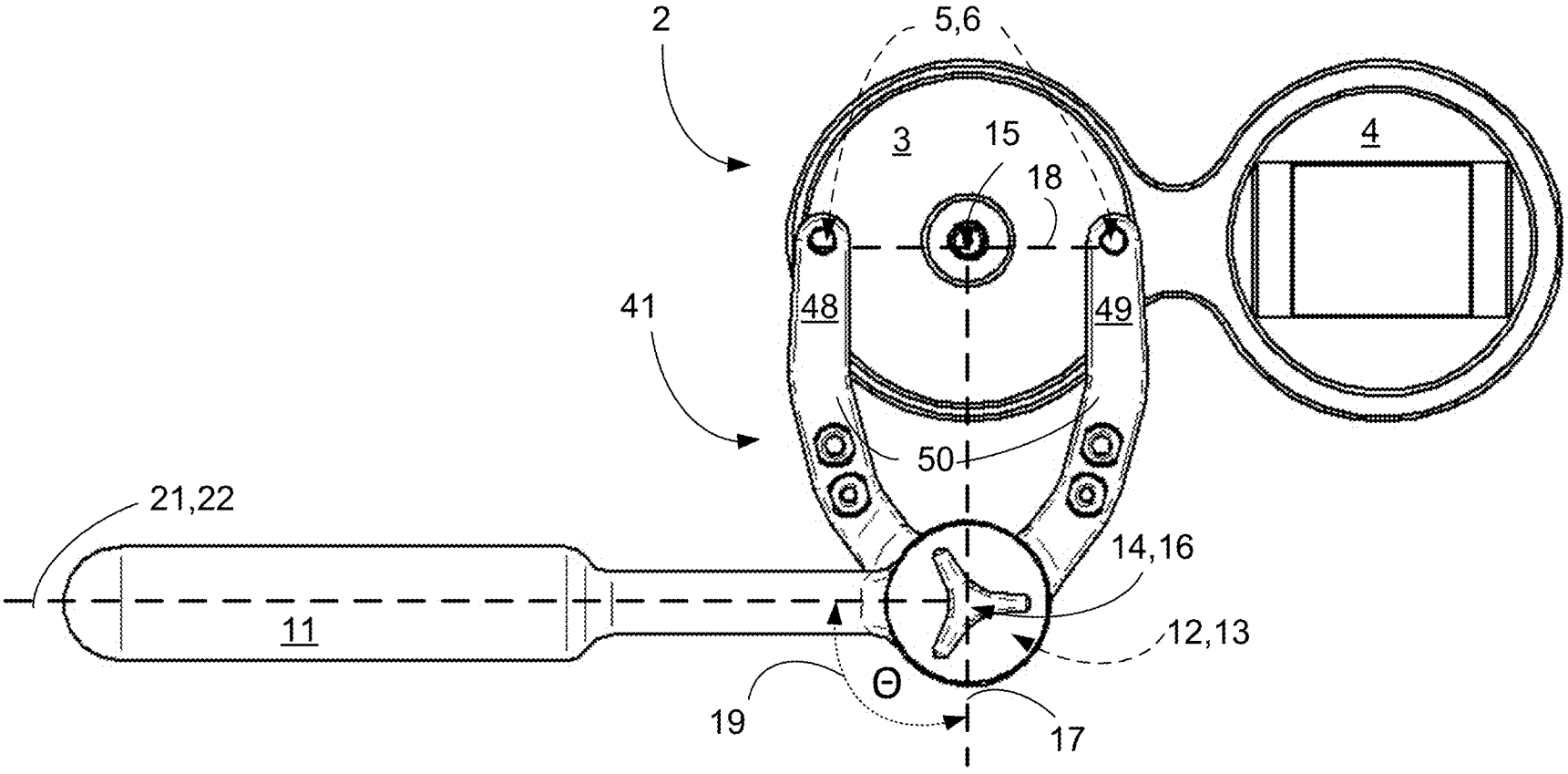
FIG. 6 shows a top plan view of the co-centric pin spanner of the present invention with a shock absorber.
Figure 7:
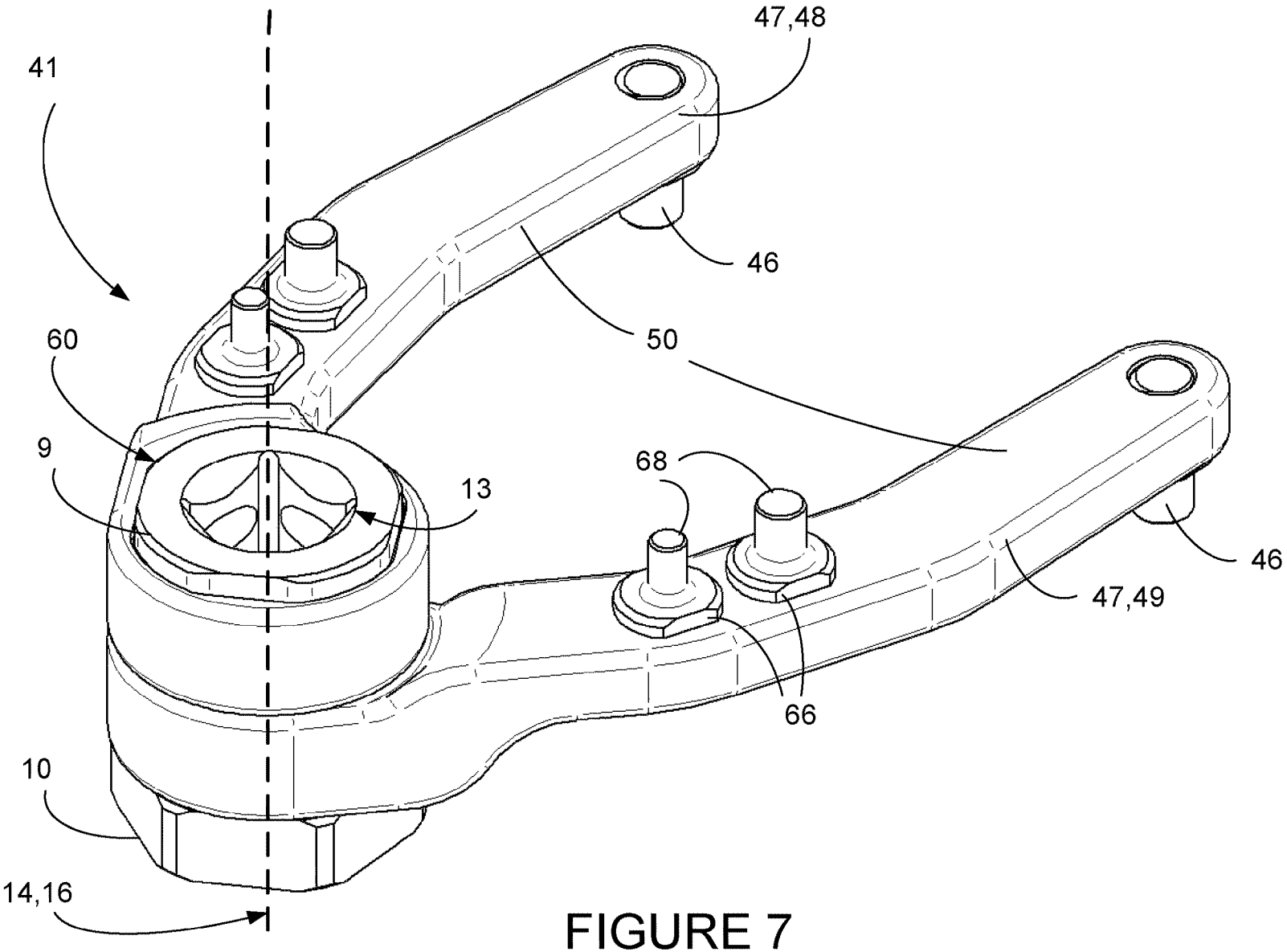
FIG. 7 shows an isometric view of the co-centric pin spanner of the present invention.
Figure 8:
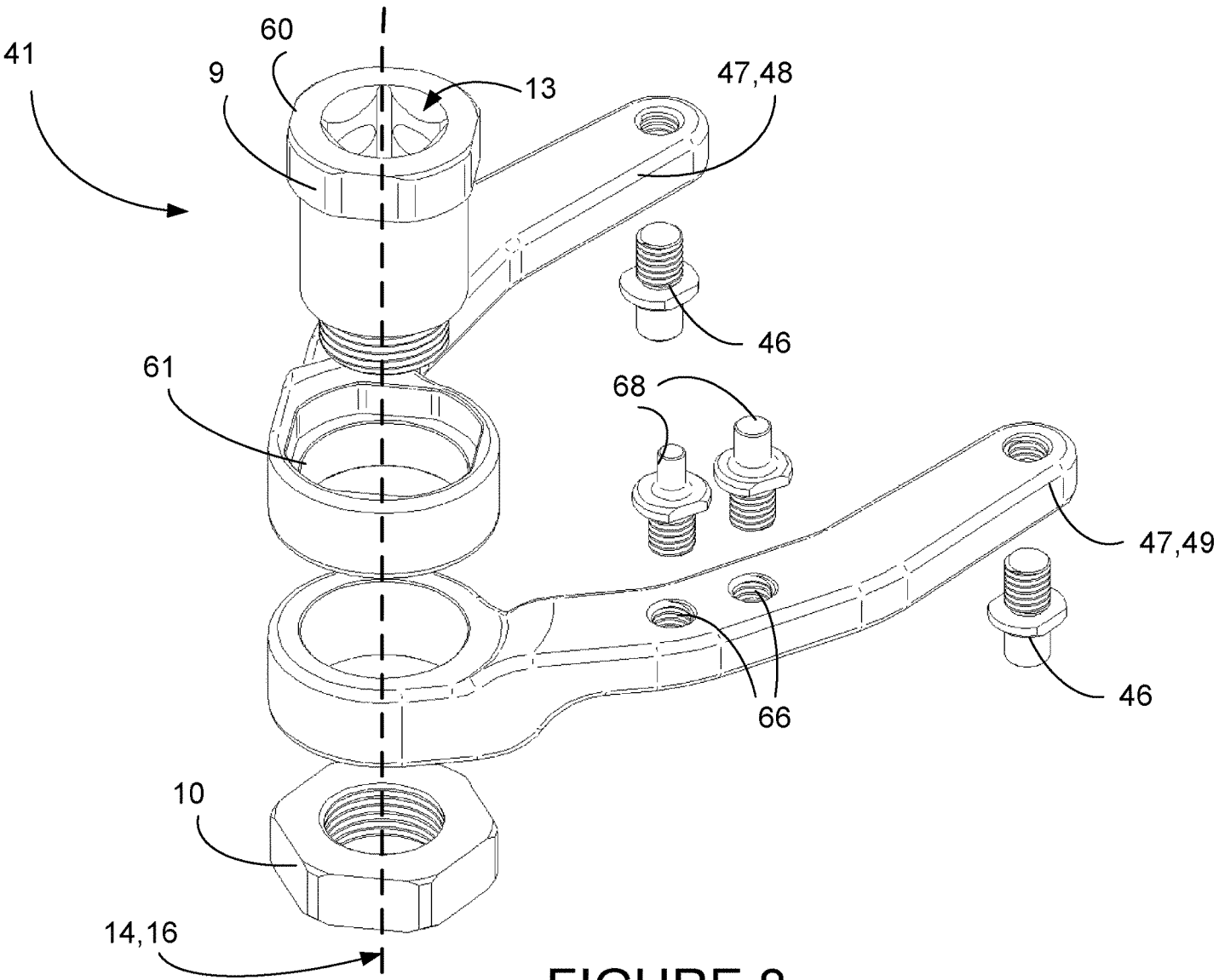
FIG. 8 shows an exploded isometric view of the co-centric pin spanner of the present invention.

The co-centric pin spanner 41 is illustrated in FIGS. 5-8. In FIGS. 5-6, the co-centric pin spanner 41 is shown engaged with a torque wrench 11 and a shock absorber 2 having a reservoir 3 with indents 5. Referring now also to FIGS. 7-8, the co-centric pin spanner 41 includes two arms 47, one of which is a driven arm 48, and one of which is a floating arm 49. Together, these two arms will be considered as an arm assembly 50. There are two pins 46 mounted at the ends of the arms 47, which engage with the indents 5 (not visible here) in the reservoir 3. A bolt 9, having a square drive slot 13, passes through holes in the arms 47 and engages a nut 10, to hold the tool together. This particular bolt 9 has a octagonal outer profile 60, which mates with an inner octagonal profile 61 in the driven arm 48, so that when the bolt 9 is turned, the driven arm 48, turns. The floating arm 49 is not constrained and is free to rotate with the bolt rotation, and also is free to spread further or closer to the driven arm 48 to accommodate different indent 6 spacings. The profile is not limited to an octagonal profile, and could be of many other non-round profiles and variations.

The torque wrench has a square protrusion or drive 12, (not visible), which engages the square drive slot 13, so that when the wrench 11 is turned, torque is applied to the bolt 9 to the arms 47, and through the pins 46 to the indents 5, and thus to the reservoir 3. The shape of the square drive is also not a limiting factor, and drives with other geometries are possible. The bolt 9 or the arm assembly 50 thus has a center of axis of rotation or arm pivot center 16, which is substantially aligned with the center of axis of rotation or pivot center 14 of the wrench 11. The substantial alignment of these two centers of rotation of the arm pivot center 16, and the pivot center 14 of the wrench drive, will be referred to as "co-centric".

As can be seen especially in FIG. 6, line 17 joins the co-centric centers of rotation 14, 16 to the center of rotation of the reservoir 3, and line 18 joins the two pins 46 or indents 5. Line 21 marks the centerline of the handle 11 and extends to meet the arm pivot center 14. Where these two lines 17, 21 cross, angle $\Theta$ 19 can be seen to be at 90 degrees, thus using the formula recited above, the equation simplifies to R=T, or torque 1=torque 2, so the torque applied by the wrench equals the torque transmitted to the shock. The ratio of torques is 1:1, there is no magnification factor, and thus no need to recalculate the applied torque settings on the wrench. This greatly simplifies operations. Line 21 also corresponds with line 22 which lies at a 90 degree angle from the line 17 which joins the the co-centric centers of rotation 14, 16 to the center of rotation of the reservoir 3.

The present invention 41 design keeps the square drive 12 location centered between the arms/pins, regardless of span adjustment position. Locating the square drive 12 in the pivot 16 of the spanner 41 keeps the tool compact. This reduces the length of the lever arm between the drive and the pins, in which the application of downward force and/or gravity to yield minimal pin lift out of the fastener/component.

The arms 47 have also been configured with extra pin slots 66 for holding a variety of extra pins 68 of various sizes.

While various embodiments have been described above, it should be understood that they have been presented by way of example only, and not limitation.

The invention claimed is:

1. A pin spanner tool for use with a driver having a center of rotation, comprising:

an arm assembly comprising a driven arm, and a floating arm, said arm assembly having a center of rotation; and a bolt connecting said driven arm and said floating arm, such that said center of rotation of said driver aligns with said center of rotation of said arm assembly, said bolt including a drive slot which is configured to receive said driver, and said bolt further including a non-round outer profile which mates with a non-round inner profile of the driven arm such that torque is transferred from rotation of said driver to rotate said driven arm.

2. The pin spanner tool of claim 1, wherein:

said driver is a square driver and said bolt has a square drive slot to engage said square driver.

3. The pin spanner tool of claim 1, wherein:

said arms include pins which engage indents in an object to be rotated, which has a center of rotation, where a line connecting said pins and a line connecting said center of rotation of said arm assembly and said center of rotation of said object to be rotated intersect in a 90 degree angle.

4. A pin spanner tool for use with a driver having a center of rotation, comprising:

a driven arm;

a floating arm; and a bolt connecting said driven arm and said floating arm, said bolt having a center of rotation where said center of rotation of said bolt and said center of rotation of said driver are co-centric, said bolt including a drive slot which is configured to receive said driver, and said bolt further including a non-round outer profile which mates with a non-round inner profile of the driven arm such that torque is transferred from rotation of said driver to rotate said driven arm.

5. The pin spanner tool of claim 4, wherein:

said driver is a square driver and said bolt has a square slot to engage said square driver.

6. The pin spanner tool of claim 4, wherein:

said arms comprise an arm assembly having a center of rotation, said arm assembly including pins which engage indents in an object to be rotated, which has a center of rotation, where a line connecting said pins and a line connecting said center of rotation of said arm assembly and said center of rotation of said object to be rotated intersect in substantially a 90 degree angle.

* * * * *